United States Patent [19]

Kubelka et al.

[11] 4,330,949

[45] May 25, 1982

[54] SHOE FOR CROSS-COUNTRY RUNNING AND CROSS-COUNTRY SKI

[75] Inventors: Axel Kubelka; Karl Stritzl, both of Vienna, Austria

[73] Assignee: Polyair Produkt Design Gesellschaft m.b.H., Kittsee, Austria

[21] Appl. No.: 131,843

[22] Filed: Mar. 19, 1980

[30] Foreign Application Priority Data

Mar. 20, 1979 [AT] Austria ..... 2091/79

[51] Int. Cl.[3] ..... A43B 5/04; A63C 9/00

[52] U.S. Cl. ..... 36/117; 280/615

[58] Field of Search ..... 36/117, 118, 119, 120, 36/121; 280/611, 614, 615, 623

[56] References Cited

U.S. PATENT DOCUMENTS

| | | | |
|---|---|---|---|
| 4,108,467 | 8/1978 | Kreyenbuhl | 36/117 |
| 4,174,121 | 11/1979 | Benseler | 36/117 |
| 4,193,215 | 3/1980 | Hensler | 36/117 |
| 4,235,452 | 11/1980 | Linocker | 36/117 |

*Primary Examiner*—Patrick D. Lawson

*Attorney, Agent, or Firm*—Scully, Scott, Murphy & Presser

[57] ABSTRACT

The cross-country ski boot (1) has protrusions (4) extending laterally downward over its sole (3), the clear width between said protrusions essentially corresponding to the width of the ski (2) so that the ski (2) is in its operating position embraced by the sole of the boot (1). The cross-country ski boot (1) is secured against being shifted in the longitudinal direction (5) of the ski (2) by a swingable locking member (17) which, when swung in a position pointing to the ski tip, releases the sole protrusion (12) of the cross-country ski boot (1) and, upon having been swung into the operating position, fastens the sole protrusion to the surface of the ski. Thus one single swingable locking element suffices to secure the cross-country ski boot (1) in its position. The boot (1) is laterally guided on the ski (2) by the lateral protrusions (4) of the sole (3). (FIG. 1).

10 Claims, 6 Drawing Figures

SHOE FOR CROSS-COUNTRY RUNNING AND CROSS-COUNTRY SKI

Figure 2:
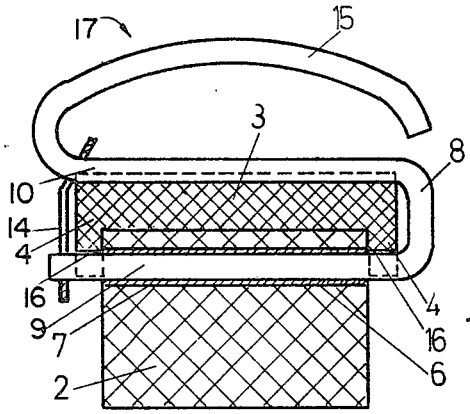

The present invention refers to a shoe for cross-country running and to a cross-country ski, the shoe for cross-country running being adapted for being connected to the upper side of the cross-country ski in a non-shiftable manner with respect to the longitudinal direction of the ski and in a non-swivelling manner with respect to an axis extending in normal direction to the plane of the ski, noting that the heel of the shoe can be lifted off the upper side of the ski. Shoes for cross-country running are, as a rule, designed for being used together with a ski binding constructed just for such a shoe. There are embodiments of such shoes for cross-country running in which the sole is provided with a protrusion extending in forward direction, said protrusion being positioned within a cheek member to be fixed on the ski such that the shoe can be swivelled in height direction and can not be swivelled in lateral direction. All these known embodiments suffer from the common drawback that the actual kinematics of the movements of the foot on running is not completely taken in consideration because the shoe sole, in spite of being relatively flexible, becomes bent only along a bending axis extending in horizontal direction and located in front of the shoe or becomes, at best, bent around a bending axis located within the toes area, so that, exactly speaking, the cross-country runner is running only with the foremost part of the foot, i.e. on the toes. Furthermore the comfort of the runner is reduced in view of the major part of the bending forces exerted when lifting the shoe off the upper side of the ski is being transmitted into the toes cap area of the shoe. The required stability of the shoe against lateral swivelling movement could only be achieved by making the sole and the sole protrusion, which must be maintained in position by the ski binding, relatively stiff, which equally detracts from the wearers comfort.

The present invention now aims at providing a shoe for cross-country running of such design that results in connection with a cross-country ski a high security against lateral movement of the shoe, thereby maintaining a high flexibility of the sole such that a rolling movement at the area of the toe balls becomes possible as is the fact on natural running movement. Simultaneously, the invention aims at avoiding the usual cheek members of ski bindings for cross-country skis and thus at providing a cross-country ski which can be transported with a minimum of space requirement in view of omitting protrusions and extensions frequently giving rise to injuries. For solving this task, the invention is essentially characterized in that the shoe for cross-country running is provided at its sole and at least in the area of the shoe tip with protrusions downwardly extending from the plane of the sole and laterally gripping the ski or a component part rigidly connected to the ski, the inner sides of said protrusions, which are directed toward the longitudinal center plane of the sole, having a distance one from the other essentially corresponding to the width of the cross-country ski to be used together with the shoe at the contacting position of the shoe tip area of the sole, and further characterized in that a locking member is pivotally connected to the ski for holding down the sole at the shoe tip area and for securing the shoe against shifting movement in longitudinal direction of the shoe, said locking member gripping over an extension provided within the shoe tip area and extending in longitudinal direction of the sole in a first pivotal position and is giving free in a second pivotal position this sole extension, noting that the lateral protrusions provided on the sole of the shoe are in any operational position gripping over the cross-country ski after having brought the sole extension in a fixed position by means of the locking member. In view of this construction, the ski binding itself can be reduced down to a pivotally arranged locking member which could even be removed in a simple manner for transporting purposes. Such cross-country skies can thus be stacked and transported immediately contacting one another. In spite of the relatively simple binding provided on the ski, a high stability against lateral pivotal movement and simultaneously an improved flexibility can be achieved because this stability is warranted by the protrusions of the shoe which laterally grip over the ski. In view of the width of cross-country skis not being standardized, a shoe or boot for cross-country running as provided by the invention is, as a rule, to be used with a corresponding cross-country ski. However, the width of cross-country skis is, as a rule, not subjected to substantial variations, so that an inventive boot for cross-country skiing can be adapted to a series of cross-country skis by simple modifications, particularly by plate members to be connected to the ski. The downwardly extending lateral protrusions of the sole result in an unobjectionable resistance against lateral rotational forces, noting that the sole itself can be made extremely flexible. Such rotational forces can, in contrast to known types of bindings for cross-country skiing boots, be supported at a position, i.e. at the area of the ball of the foot of the cross-country skier, where such forces are primarily exerted.

For reliably positioning the cross-country ski boot against shifting movement in longitudinal direction of the ski, the inventive cross-country skiing boot is preferably designed such that both lateral protrusions of the sole have at least one recess or perforation, said perforations being in alignment in transverse direction to the longitudinal direction of the sole and being provided at the shoe tip area, said recesses or perforations cooperating with a locking member fixed to the ski and extending in transverse direction to the longitudinal direction of the ski. Such recesses or perforations can, for instance, be locked by means of an axis protruding from the ski, so that relative movement of the ski boot in longitudinal direction of the ski can be prevented. In this case, the locking member can be formed of a pin or of a bow and preferably serves also the purpose of pressing to the surface of the ski that part of the sole which protrudes over the shoe tip.

According to a further preferred embodiment of a cross-country skiing boot of the invention the arrangement is such that that part of the sole which protrudes over the shoe tip in forward direction has a hole, particularly a slot opening in forward direction, between the lateral protrusions, said hole or slot accommodating a locking member fixed to the ski. In view of lateral shifting movement of the ski boot being prevented by the protrusions provided on the sole itself and gripping over the ski, the locking members can be of relatively simple construction and one can essentially do with a pin penetrating that portion of the sole which protrudes over the shoe tip and having its free end formed such that that portion of the sole which protrudes over the shoe tip can in operating position not escape engagement with the pin. The mentioned hole can have the shape of a slot extending in longitudinal direction of the sole for providing the possibility to introduce the locking member in a simple manner, noting that the desired lock can, for instance, be achieved by means of a frog eccentrically supported at the free end of the pin penetrating the slot.

Preferably, that portion of the sole which protrudes in forward direction over the shoe tip has at its side opposing the sole at least one recess or groove extending in transverse direction relative to the longitudinal direction of the sole for accommodating a holding bow and/or can be provided with a friction-increasing layer. In this manner, a pivotable holding bow arranged on the ski can in one of its pivotal positions grip over the portion of the sole protruding over the shoe tip in forward direction and maintain the shoe in its locked position in a simple manner. Preferably, also the heel portion of the shoe is provided with protrusions extending from the sole, the distance of this protrusions from each other decreasing in direction to the sole, noting that the ski is at its side edges adjacent the top surface and at the contacting area of the heel portion chamferred in correspondence to the profile of the heel portion. In this manner, some centering action can be exerted when putting the shoe on the ski and the flexibility of the material of the sole can further be increased.

The cross-country ski of the invention is essentially characterized in that the ski is provided beneath its top surface with lateral recesses or with a through-passage extending in transverse direction relative to the longitudinal direction of the ski, said recesses or said through-passage being adapted for accommodating the locking member. In view of the construction of a ski boot according to the invention, the required ski binding parts are reduced down to recesses or through-passages in the ski for accommodating bows or pins or the like. Preferably, bushings are inserted into said lateral recesses and an essentially C-shaped bow can be introduced into said bushings, the free ends of said bow forming the locking member and the middle portion of said bow pressing down in one of its pivotal positions the sole portion protruding in forward direction over the shoe tip such that it contacts the top surface of the ski. Such a C-shaped bow can, particularly if its free ends are cooperating with recesses or perforations of the lateral protrusions of the sole, form with its free ends the locking member acting against shifting movement of the shoe in longitudinal direction of the ski. The shoe tip can be pressed to the top side of the ski by means of the middle portion of such a C-shaped bow which is, for example, engaging a groove on the top surface of the sole portion protruding over the shoe tip or is cooperating with a friction-increasing layer provided in place of the mentioned groove or in addition to such a groove.

The arrangement can be simply such that the center portion of the C-shaped bow, which essentially is in parallel relation to the pivotal axis of said bow, is outwardly bent to form an U and in that the mutually parallel legs of said U-shaped bend are secured against becoming widened by means of a clamping clip. This arrangement provides for a substantial simplification of mounting work because the C-shaped bow can be easily widened in view of its U-shaped section of its middle portion and thus can easily be inserted into lateral recesses, particularly bushings provided in the ski, noting that the clamping clip prevents unintentional widening of the bow after having mounted the bow.

The construction of the ski can, however, also be such that the through-passage extending in transverse direction to the longitudinal axis of the ski is formed of a bore into which a tubular bushing is optionally inserted, an essentially C-shaped bow or a pin extending through the ski being insertable into said bore or tubular bushing and the portion of the pin protruding from the bore or bushing being bent back for forming a bow pressing down the sole portion protruding over the shoe tip in forward direction, noting that, preferably, the free end of the pin and the backwardly bent portion of the bow are connected by a fastening member. In this manner, a particularly simple binding is provided for maintaining the tip portion of the shoe in position, because lateral guiding is warranted by the downwardly extending protrusions of the sole. A further embodiment of an inventive cross-country ski is characterized in that the top surface of the ski is provided with at least one recess or hole for accommodating at least one locking pin which is cooperating with its end extending above the top surface of the ski with the top side of the sole portion protruding over the shoe tip in forward direction and opposing the top surface of the ski, preferably with interposition of a frog pivotally and eccentrically supported on an axis transversely extending to the axis of the pin. A ski of such design is preferably used in combination with a shoe being provided with a slot opening in forward direction within the sole portion protruding over the shoe tip. With such a construction, it is quite simple to rapidly enter the ski binding and to rapidly loosen the ski binding. Of course, a locking pin of the type described can be provided with a thread on its portion protruding over the top surface of the ski and over the sole portion protruding in forward direction, noting that said sole portion can then be maintained in position by tightening a simple nut. If the sole portion protruding over the shoe tip shall be fixed in position by means of a frog, it might be advantageous to provide a subdivided locking pin, the subdivision being such that the locking pin can be adjusted in height direction for adjusting the correct location of the pressing surface of the frog. This can be achieved in a simple manner if the locking pin is provided with an external thread which is engaging an internal thread of a constructional part stationarily arranged at the top surface of the ski. It is thus possible to countersink on the top surface of the ski a constructional part provided with a female thread or to introduce into a recess provided on the top surface of the ski one part, provided with a female thread, of a bipartite locking pin and to screw into this female thread the external thread of the other part of the locking member.

The invention is further illustrated with reference to the drawing showing various embodiments having incorporated further details essential for the invention.

Figure 1:
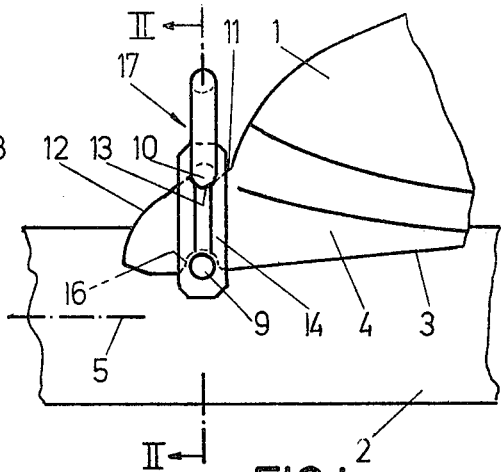
Figure 6:
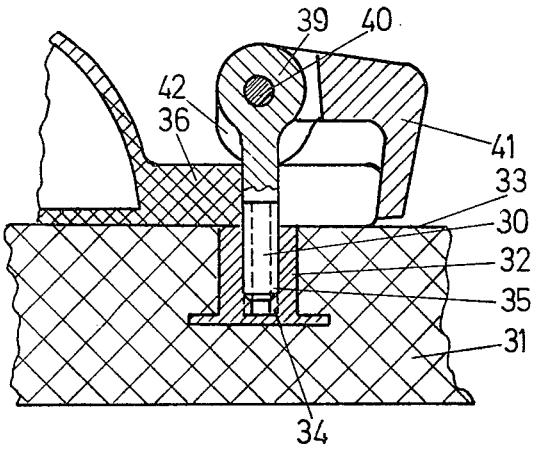
Figure 5:
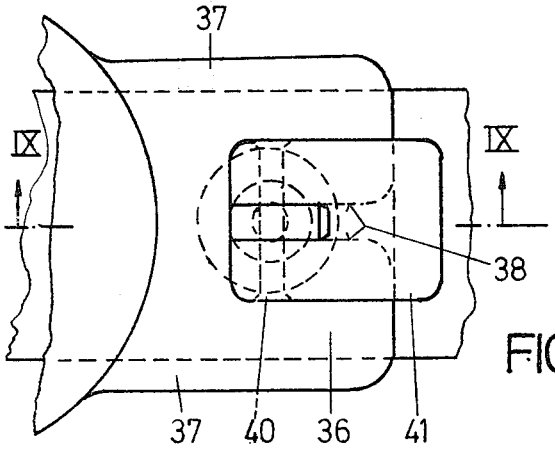
Figure 4:
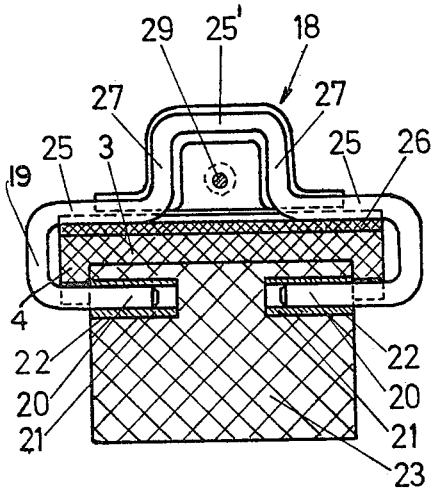
Figure 3:
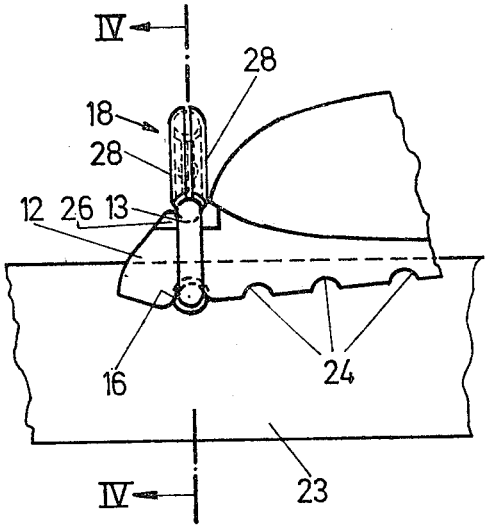

In the drawing:

FIG. 1 is a side view showing a cross-running ski boot according to the invention on a cross-running ski according to the invention, FIG. 2 is a section along line II—II of FIG. 1, FIG. 3 shows a modified embodiment of FIG. 1, FIG. 4 is a cross section along line IV—IV of FIG. 3, FIG. 5 shows a further embodiment of a ski boot according to the invention in a top plan view of its forward end together with part of the ski and FIG. 6 shows a cross section along line VI—VI of FIG. 5.

In FIG. 1 there is shown the front portion of a cross-running ski boot 1 in a side elevation. The ski is designated 2. The sole 3 of the shoe or boot 1 has protrusions 4 at the area of the shoe tip, said protrusions laterally overgripping the ski 2 as can best be seen in FIG. 2. The ski 2 has a through-passage 6 extending in transverse direction to the longitudinal axis 5 of the ski 2, said through-passage being cladded with a tube 7. A locking member essentially formed of a U-shaped bow 8 is inserted into this tube 7. One leg 9 of the U-shaped portion 8 is passed through the tube 7 and the leg 10 of the U-shaped bow 8 extending in parallel relation to the leg 9 is, in one of its pivotal positions, overgripping the portion 12 of the sole which protrudes over the shoe tip 11. This protruding portion of the sole is provided with a transversely extending groove 13 within which the leg 10 of the U-shaped bow 8 can come to rest so that the cross running ski boot 1 is secured against shifting movement in axial direction 5 of the ski 2. The free end of the leg 9 and of the parallely extending leg 10 of the U-shaped bow are mutually connected to one another by means of a closure member 14 which can be pressed onto said free ends or can be locked to these ends. The leg 10 of the bow 8, which overgrips the sole portion 12 protruding over the shoe tip 11, is bent back for forming a grip portion 15 which facilitates operation, particularly loosening of the binding.

For reliably preventing any shifting movement of the shoe in direction of the axis 5 of the ski 2, the downwardly extending protrusions 4, which laterally overgrip the ski 2, are provided with recesses 16. These recesses 16, which are provided in the protrusions at both sides of the sole 3, are in alignment with the leg 9 of the locking member so that the leg 9 of the U-shaped bow 8 is passing through this recesses. In this manner the shifting forces exerted in direction of the axis 5 are reliably supported so that the cross running ski boot 1 is securely positioned on the ski 2. The locking member is designated 17 in the FIGS. 1 and 2.

FIGS. 3 and 4 show a further locking member 18 being formed of an essentially C-shaped bow 19, the free ends 20 of which are pivotally supported in bushings 21 being inserted into recesses 22 of the ski 23. Here again, the sole 3 of the shoe has downwardly extending protrusions 4 in which are provided recesses 16 and further recesses 24. The recesses 16 located at both sides of the sole 3 are cooperating with the free ends 20 of the C-shaped bow 19 so that the boot is prevented from becoming shifted in axial direction. The recesses 24 serve the purpose of increasing the flexibility and bending capability, respectively, of the sole. Here again, a groove 13 is provided on the top surface of the sole portion 12 protruding over the shoe tip, said groove cooperating with a middle portion 25′ of the C-shaped bow 19 which is resting in the groove 13 after having correspondingly rotated the C-shaped bow 19. The top surface comprises at the area of the groove 13 a layer 26 of friction-increasing material.

The middle portion 25′ of the C-shaped bow 19 is bent to the shape of an U directed in outward direction and has two essentially parallely extending legs 27. This provides for the possibility to mount the C-shaped bow 19 in a simple manner because the bow 19 can more easily be expanded in view of this bend. For securing the C-shaped bow in its operational position, a bipartite clamping clip 28 is provided which is rivetted in its center portion at 29. After having rivetted the clamping clip 28, any expanding of the C-shaped bow 19 is prevented and the C-shaped bow 19 is securely maintained in its mounting position.

The FIGS. 5 and 6 show a further embodiment of a locking member 30. One part 32 of the locking member 30 is anchored within the ski 31, said part 32 being provided at its end located adjacent the surface 33 of the ski 31 with a female thread 34. The external thread 35 of the other part of the locking member 30 is screwed into said female thread 34 and the protrusion 36 protruding from the shoe tip and comprising the protrusion 37 laterally gripping the ski 31 is provided at its front end with a slot 38 being open in forward direction. Thus, the shoe can in a simple manner be shifted over the locking member 30 whereby the locking member 30 enters the slot 38. An eccentric lever 41 is pivotally linked around an axis 40 on the part 39 of the locking member 30 which is provided with the external thread 35, the nose 42 of the eccentric lever 41, which is eccentric with respect to said nose 42, pressing down against the top surface 33 of the ski 31 in the pivotal position shown in FIGS. 5 and 6 the sole portion 36 protruding over the shoe tip. In view of said pressing action possibly becoming reduced with lapse of time by wear of the surface of the protrusion 36 and thus giving the protrusion 36 protruding over the shoe tip the opportunity to leave the locking member on account of the slot 38, adjustability of the exerted pressing force by rotating the external thread 35 within the female thread 34 is of particular advantage.

In this case it is without further possible to put the part provided with the female thread or the locking bolt itself through a hole provided in the ski because the running treads or layers of cross-country skis can be subsequently applied to the ski. In such a case, the locking member can be put through the ski from the underside, whereupon the locking member is hidden or covered by the subsequently applied running tread or layer.

What is claimed is:

1. Shoe for cross-country running and cross-country ski, the shoe for cross-country running being adapted for being connected to the upper side of the cross-country ski in a non-shiftable manner with respect to the longitudinal direction of the ski and in non swivelling manner with respect to an axis extending in normal direction to the plane of the ski, noting that the heel of the shoe can be lifted off the upper side of the ski, characterized in that the shoe for cross-country running is provided at its sole and at least in the area of the shoe tip with protrusions downwardly extending from the plane of the sole and laterally gripping the ski or a component part rigidly connected to the ski, the inner sides of said protrusions, which are directed to the longitudinal center plane of the sole, having a distance one from the other essentially corresponding to the width of the cross-country ski to be used together with the shoe at the contacting position of the shoe tip area of the sole and further characterized in that a locking member is pivotally connected to the ski for holding down the sole at the shoe tip area and for securing the shoe against shifting movement in longitudinal direction, said locking member gripping over an extension provided within the shoe tip area and extending in longitudinal direction in a first pivotal position and is giving free in a second pivotal position this sole extension, noting that the lateral protrusions provided on the sole of the shoe are, in any operational position, gripping over the cross-country ski after having brought the sole extension in a fixed position by means of the locking member.

2. Shoe for cross-country running and cross-country ski, the shoe for cross-country running being adapted for being connected to the upper side of the cross-country ski in a non-shiftable manner with respect to the longitudinal direction of the ski and in non-swivelling manner with respect to an axis extending in normal direction to the plane of the ski, characterized in that the shoe for cross-country running is provided at its sole and at least in the area of the shoe tip with lateral protrusions downwardly extending from the plane of the sole and laterally gripping the ski or a component part rigidly connected to the ski; a locking member is pivotally connected to the ski for holding down the sole at the shoe tip area; and said lateral protrusions of the sole having at least one recess or perforation, said perforations being in alignment in transverse direction to the longitudinal direction of the sole and being provided at the shoe tip area, said recesses or perforations cooperating with a locking member mounted on the ski and extending in transverse direction to the longitudinal direction of the ski.

3. Cross-running ski shoe according to any of claims 1 or 2, characterized in that that part of the sole which protrudes over the shoe tip in forward direction has at least one hole, particularly a slot opening in forward direction, between the lateral protrusions, said hole or holes or slot accommodating a locking member fixed to the ski.

4. Cross-country ski shoe according to claims 1 or 2, characterized in that that portion of the sole which protrudes in forward direction over the shoe tip has at its side facing away from the sole at least one recess or groove extending in transverse direction relative to the longitudinal direction of the sole for accomodating a holding bow and/or is provided with a friction-increasing layer.

5. Cross-running ski shoe as claimed in claims 1 or 2, characterized in that the heel portion of the shoe is provided with protrusions extending over the sole, the distance of this protrusions from each other decreasing in direction to the sole, noting that the ski is at its side edges adjacent the top surface and at the contacting area of the heel portion chamferred in correspondence to the profile of the heel portion.

6. Cross-country ski according to claim 1 or 2, characterized in that the ski is provided beneath its top surface with lateral recesses or with a through-passage extending in transverse direction relative to the longitudinal direction of the ski, said recesses or through-passage being adapted for accomodating the locking member.

7. Cross-country ski according to claim 1 or 2, characterized in that bushings are inserted into said lateral recesses and an essentially C-shaped bow being insertable into said bushings, the free ends of said bow forming the locking member and the middle portion of said bow pressing down in one of its pivotal positions the sole portion protruding in forward direction over the shoe tip such that it contacts the top surface of the ski.

8. Cross-country ski according to claim 7, characterized in that the center portion of the C-shaped bow, which is essentially in parallel relation to the pivotal axis of said bow, is outwardly bent to form an U and in that the mutually parallel legs of said U-shaped bend are secured against widening by means of a clamping clip.

9. Cross-country ski according to claims 1 or 2, characterized in that the through-passage extending in transverse direction to the longitudinal axis of the ski is formed of a bore into which a tubular bushing is optionally inserted, an essentially C-shaped bow or a pin extending through the ski being insertable into said bore or tubular bushing and the portion of the pin protruding from the bore or bushing being bent back for forming a bow for pressing down the sole portion protruding over the shoe tip in forward direction, noting that, preferably, the free end of the pin and the backwardly bent portion are connected by a closure member.

10. Cross-country ski according to claim 1, characterized in that the top surface of the ski is provided with at least one recess or hole for accommodating at least one locking pin which is cooperating with its end extending above the top surface of the ski with the top side of the sole portion protruding over the shoe tip in forward direction and facing away from the top surface of the ski, preferably with interposition of a frog pivotally and eccentrically supported on an axis transversely extending to the axis of the pin.

* * * * *